United States Patent [19]

Lau

[11] Patent Number: 4,659,597

[45] Date of Patent: Apr. 21, 1987

[54] COLLAPSIBLE ARTIFICIAL CHRISTMAS TREE

[76] Inventor: Arthur H. Lau, 109 Princeton Rd., Colonial Heights, Va. 23834

[21] Appl. No.: 829,691

[22] Filed: Feb. 14, 1986

[51] Int. Cl.[4] ..... A47G 33/06

[52] U.S. Cl. ..... 428/9; 211/196; 428/18

[58] Field of Search ..... 211/196, 197, 205; 156/61; 362/123; 428/9, 12, 18, 20

[56] References Cited

U.S. PATENT DOCUMENTS

| | | | |
|---|---|---|---|
| 843,712 | 2/1907 | Straub | 428/18 X |
| 1,590,220 | 6/1926 | Wurts | 211/197 |
| 1,683,637 | 9/1928 | Trimpe | 428/8 |
| 2,708,324 | 5/1955 | Wedden | 428/18 X |
| 3,030,720 | 4/1962 | Osswald et al. | 428/8 |
| 3,085,774 | 4/1963 | Di Ienno | 428/20 X |
| 3,374,798 | 3/1968 | Samuelson | 211/197 X |
| 3,574,102 | 4/1971 | Hermanson | 428/20 X |
| 3,616,107 | 10/1971 | Kershner | 428/9 |
| 3,637,179 | 1/1972 | Marschak | 211/205 X |
| 3,639,196 | 2/1972 | Hermanson | 428/20 X |
| 3,808,082 | 4/1974 | Steiber | 428/20 X |
| 3,811,991 | 5/1974 | Dieffenbach | 428/20 X |
| 3,846,213 | 11/1974 | Thiemann | 428/9 |
| 4,140,823 | 2/1979 | Weskamp | 428/20 X |
| 4,550,840 | 11/1985 | Van Deursen | 211/197 |

*Primary Examiner*—Henry F. Epstein

*Attorney, Agent, or Firm*—Norman B. Rainer

[57] ABSTRACT

An artificial Christmas tree is constructed in a manner to be transformable between a compact storage state and an erected state. The tree has an elongated trunk and a series of branch assemblies spaced upon its trunk. An upper collar is slidably disposed upon the trunk in association with each branch assembly. When the upper collar is moved downwardly, lever arms pivotably attached to the collar causes branch elements to move away from the trunk and assume a tree-like upwardly angled disposition.

5 Claims, 4 Drawing Figures

COLLAPSIBLE ARTIFICIAL CHRISTMAS TREE

BACKGROUND OF THE INVENTION

This invention relates to artificial trees, and more particularly concerns an artificial Christmas tree easily erectable from a compact storage state.

Artificial Christmas trees are well known. Most artificial Christmas trees comprise a multiplicity of separate branches each formed of a plurality of plastic needles held together by twisting a pair of wires about them. In other instances, the branches are formed by twisting a pair of wires about an elongated sheet of plastic material having a large multiplicity of transverse slits. In still other artificial Christmas trees, the branches are formed by injection molding of plastic.

Irrespective of the form of branch, the most common form of artificial Christmas tree comprises a wooden simulated trunk having a plurality of spaced apart apertures for reception of branches therein to thereby hold the branches in radially extending relation to the trunk to form the artificial Christmas tree. For purposes of storage, the branches are removable, requiring the repositioning of the branches on the trunk each time the tree is reassembled. The difficulty of this task is, however, somewhat reduced by color coding the apertures on the trunk with the ends of the branches.

To provide a tree which can be stored without occupying an unduly large amount of space and yet to avoid the need for totally dismantling the tree at the end of each Christmas season and reassembling at the beginning of the next, it has been proposed, as disclosed in a number of patents, to permanently pivotally affix the artificial branches of an artificial Christmas tree to the trunk thereof to permit movement of the branches between an outwardly deployed position and a storage position in which the branches lie close to the trunk and thereby occupy a comparatively small space. Such a structure was suggested in U.S. Pat. No. 1,683,637 issued to E. H. Trimpe on Sept. 11, 1928 as well as in U.S. Pat. No. 3,030,720 issued to Osswald et al on Apr. 24, 1962. However, both of these patents require elaborate assembly techniques, and in the case of the Osswald et al patent, a somewhat complex structure, thereby rendering both of these prior art patents of little importance in commercial development of artificial Christmas trees.

Most recently, U.S. Pat. Nos. 3,574,102 and 3,639,196, both issued to T. Hermanson have disclosed other artificial Christmas trees with foldable branches. The structures disclosed therein, however, require that the trunk be apertured to permit insertion of either the rear ends of the branches or of a branch connecting member therein. In addition, the structure described in the two Hermanson patents requires some form of bifurcation at the ends of the branches, which bifurcation requires special tooling not heretofore employed in the making of artificial Christmas trees.

To avoid the necessity of aperturing the trunk, a number of patents have suggested providing a branch holder which may be secured to the trunk of the tree and to which a branch or branches may be secured for pivotal movement between an extended position and a collapsed position. For example, U.S. Pat. No. 2,708,324 issued to M. J. Wedden discloses a branch holder for pivotally securing a single branch to the trunk. However, the separate manipulation of branches for deployment and storage is time consuming and conducive to uneven deployment of the branches.

The problems presented by Wedden have been partially overcome by employing branch holders in the form of collars which may be distributed along the length of the trunk and to which a plurality of branches may be pivotally secured. For example, U.S. Pat. No. 3,616,107 issued to Kershner discloses a collar in which pivoting movement of the branches is accommodated by hinged portions which join the branches to a main collar. According to this patent, however, the branches are integrally formed with the collar. Moreover, since the branches are only joined to the main collar through the thin hinge portions, which therefore bear the entire weight of the branch when same is in the collapsed position, possible failure of these collars with prolonged use is possible.

It is accordingly an object of the present invention to provide an artificial Christmas tree which can be easily erected from a collapsed compact storage state.

It is a further object of this invention to provide an artificial Christmas tree as in the foregoing object whose branches are sufficient in number and distribution to provide a tree having a full and uniform appearance.

It is another object of the present invention to provide an artificial tree of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by an artificial Christmas tree comprising:

(a) an elongated rigid trunk having upper and lower extremities, (b) a base adapted to engage said lower extremity in a manner to support said trunk in a vertically upright disposition in the erected state of the tree, and (c) a series of branch assemblies positioned upon said trunk, each assembly comprising:

(1) an upper collar slidably disposed upon the trunk, (2) a number of first lever arms uniformly disposed about said trunk, having upper extremities pivotably attached to said upper collar in a manner permitting movement of said arms in vertical paths, said arms being downwardly angled away from said trunk to lowermost extremities, (3) a lower collar affixed to the trunk, (4) a second lever arm associated with each first lever arm in vertically coplanar relationship, each second lever arm having a lower extremity pivotably attached to said lower collar in a manner permitting movement of said arm in a vertical path, said second arms being upwardly angled away from said trunk to an uppermost extremity which pivotably engages the associated first lever arm, (5) an elongated branch element pivotably attached to the lowermost extremity of each first lever arm and extending between an outermost extremity and an innermost extremity located below said first lever arm, and (6) a third lever arm pivotably interconnected to each second lever arm and the innermost extremity of the associated branch element to form a parallelogram having pivotal movement at its four apexes, whereby (7) sliding movement of said upper collar downwardly upon the trunk toward said lower collar causes the branch elements to be laterally displaced from the trunk and upwardly angled therefrom to produce the erected state of the tree, and opposite movement of said upper collar causes said first, second and third lever arms and branch elements to be drawn close to said trunk and in substantially coaxial alignment therewith, producing the storage state of the tree, (8) the dimensions of each branch assembly of said series being such that the outermost extremities of the branch elements in the erected state extend further from the trunk in descending the members of the series.

In preferred embodiments of the invention, the trunk is of circular cylindrical configuration. There are preferably between about 5 and 8 branch assemblies uniformly spaced upon the trunk. Each branch assembly preferably has between about 6 and 10 branch elements. The branch elements may have the form and appearance of the final branches of the tree, or they may merely constitute the support for imitative tree branch material. In the erected state, the branch elements extend upwardly at an angle of between about 45 and 55 degrees with respect to the trunk.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

For convenience in description, the terms "innermost" and "outermost" or expressions of similar import will have reference to the center axis of the trunk of the tree.

DESCRIPTION OF THE PREFERRED EMBODIMENT

Figure 1:
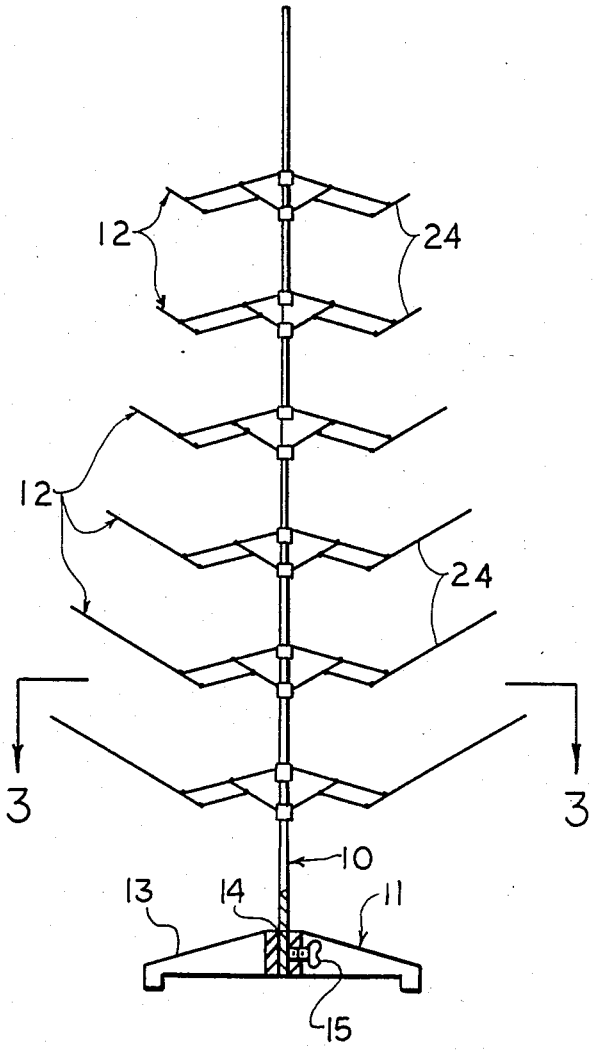
FIG. 1 is a side view of an embodiment of the artificial Christmas tree of the present invention in its erected state.
Figure 2:
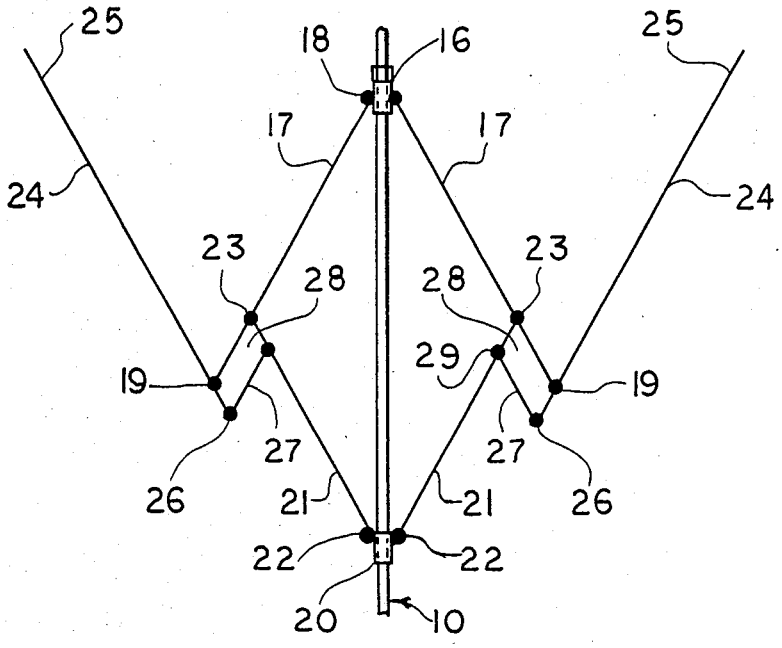
FIG. 2 is an enlarged side view of a branch assembly of the tree of FIG. 1 in a semi-closed position approaching the storage state of the tree.
Figure 4:
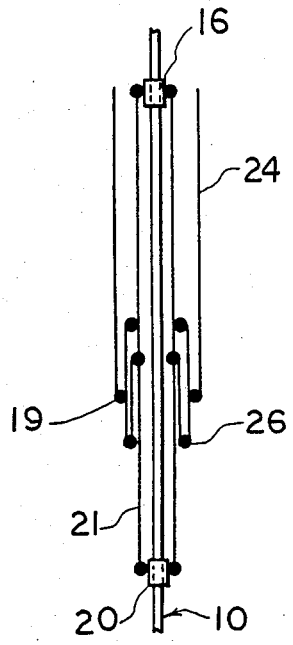
FIG. 4 is an enlarged fragmentary side view of the tree in its storage state.
Figure 3:
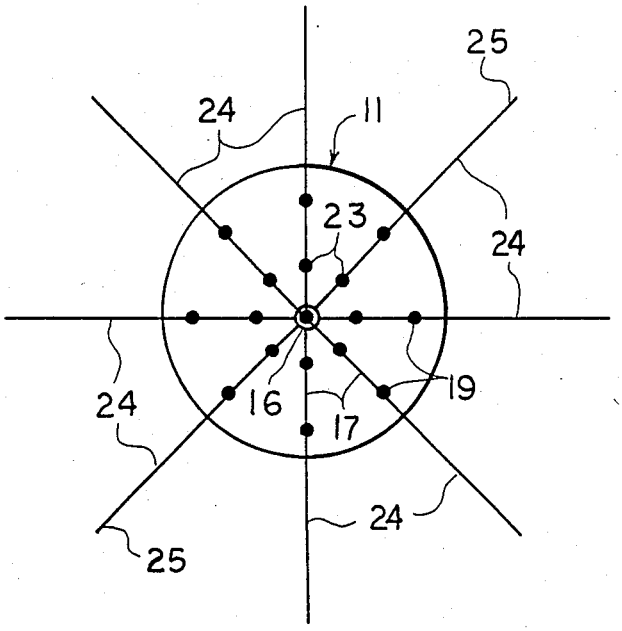
FIG. 3 is a sectional view taken along the line 3—3 of FIG. 1.

Referring to FIG. 1 of the drawing, an embodiment of the artificial Christmas tree of the present invention is shown comprised of a trunk 10 held vertically upright by circular base 11, and a series of six branch assemblies 12 positioned upon the trunk.

The trunk of the illustrated embodiment is a single pipe of circular cylindrical configuration. In other embodiments, the trunk may be comprised of interlocking segments. When the trunk is of integral monolithic construction, it will have a uniform cross-sectional configuration along its axis of elongation. When the trunk is fabricated of separate segments, the several segments may have different but uniform outside configurations.

The base may be comprised of a platform 13 and trunk-receiving socket 14 centered in said platform and may be provided with screw-type locking means 15 to prevent rotative movement of the tree positioned within the socket.

Each branch assembly, as shown in FIGS. 1–4, is comprised of an upper collar 16 slidably disposed upon the trunk 10. Eight straight rigid first lever arms 17 are uniformly disposed about the trunk, having upper extremities 18 which are pivotably attached to collar 16 in a manner permitting movement of said arms in vertical paths. Said first arms are downwardly angled away from the trunk to lowermost extremities 19. Lower collar 20 is affixed to the trunk 10 below associated upper collar 16. A second lever arm 21 is associated with each first lever arm, each second lever arm having a lower extremity 22 pivotably attached to said lower collar in a manner permitting movement of said arm in a vertical path. Said second arms are upwardly angled away from the trunk to an uppermost extremity 23 which pivotably engages the associated first lever arm.

An elongated branch element 24 is pivotably attached to the lowermost extremity 19 of each first lever arm, and extends between an outermost extremity 25 and an innermost extremity 26 located below said first lever arm. A third lever arm 27 is pivotably connected to the second lever arm at site 29 and pivotably connected to the innermost extremity 26 of the branch element, thereby forming a parallelogram 28 having pivotal movement at its four apexes.

By virtue of the configuration and arrangement of the various components, the tree is brought to its erected form as shown in FIG. 1, by placing the tree in an unhindered vertical position and causing each upper collar to slide downward toward its associated lower collar. Such action causes the branch elements to be moved laterally from their folded state, shown in FIG. 4, and then to an upwardly divergent angular disposition with respect to the trunk.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An artificial Christmas tree transformable in configuration between a compact storage state and an erected state comprising:

(a) an elongated rigid trunk having upper and lower extremities, (b) a base constructed to engage said lower extremity in a manner to support said trunk in a vertically upright disposition, and (c) a series of branch assemblies positioned upon said trunk, each assembly comprising:

(1) an upper collar slidably disposed upon the trunk, (2) a number of first lever arms uniformly disposed about said trunk, having upper extremities pivotably attached to said upper collar in a manner permitting movement of said arms in vertical paths, said arms being downwardly angled away from said trunk to lowermost extremities, (3) a lower collar affixed to the trunk, (4) a second lever arm associated with each first lever arm in vertically coplanar relationship, each second lever arm having a lower extremity pivotably attached to said lower collar in a manner permitting movement of said arm in a vertical path, said second arms being upwardly angled away from said trunk to an uppermost extremity which pivotably engages the associated first lever arm, (5) an elongated branch element pivotably attached to the lowermost extremity of each first lever arm and extending between an outermost extremity and an innermost extremity located below said first lever arm, and (6) a third lever arm pivotably interconnected to each second lever arm and the innermost extremity of the associated branch element to form a parallelogram having pivotal movement at its four apexes, whereby (7) sliding movement of said upper collar downwardly upon the trunk toward said lower collar causes the branch elements to be laterally displaced from the trunk and upwardly angled therefrom to produce the erected state of the tree, and opposite movement of said upper collar causes said first, second and third lever arms and branch elements to be drawn close to said trunk and in substantially parallel alignment therewith, producing the storage state of the tree, (8) the dimensions of each branch assembly of said series being such that the outermost extremities of the branch elements in the erected state extend further from the trunk in descending the members of the series.

2. The tree of claim 1 wherein said trunk is of circular cylindrical configuration.

3. The tree of claim 1 having between 5 and 8 branch assemblies uniformly spaced upon the trunk.

4. The tree of claim 1 wherein each branch assembly contains between 6 and 10 branch elements.

5. The tree of claim 1 wherein, in its erected state, the branch elements extend upwardly at an angle of between about 45 and 55 degrees with respect to the trunk.

* * * * *